United States Patent [19]

Schuda

[11] Patent Number: 5,072,158

[45] Date of Patent: Dec. 10, 1991

[54] SILENT LAMP IGNITER

[75] Inventor: Felix J. Schuda, Cupertino, Calif.

[73] Assignee: ILC Technology, Inc., Sunnyvale, Calif.

[21] Appl. No.: 598,226

[22] Filed: Oct. 16, 1990

[51] Int. Cl.[5] ..... H05B 41/24

[52] U.S. Cl. ..... 315/276; 336/100

[58] Field of Search ..... 315/276, 277, 268; 336/96, 98, 100, 221, 233, 185

[56] References Cited

U.S. PATENT DOCUMENTS

| | | | |
|---|---|---|---|
| 2,784,384 | 3/1957 | Vance | 336/100 |
| 2,909,741 | 10/1959 | Arnatzen et al. | 336/100 |
| 3,018,455 | 1/1962 | Brandon | 336/100 |
| 3,290,635 | 12/1966 | Hofmann | 336/100 |
| 3,683,303 | 8/1972 | Ayano | 336/100 |
| 3,704,390 | 11/1972 | Grahame | 315/276 |
| 4,000,406 | 12/1976 | Bhavsar | 336/100 |

*Primary Examiner*—Eugene R. LaRoche
*Assistant Examiner*—A. Zarabian
*Attorney, Agent, or Firm*—Thomas E. Schatzel

[57] ABSTRACT

The present invention comprises a transformer having a magnetic core that is smaller and shorter than the winding form for the primary and secondary coils, the core is surrounded by an sound deadening and insulating material, such as foam, and is encased in a sealed tube.

10 Claims, 2 Drawing Sheets

SILENT LAMP IGNITER

BACKGROUND OF THE INVENTION

1. Field of the Invention

The invention relates generally to metal halide lamps and more specifically to lamp igniters which do not emit high frequency acoustic noise when used with square-wave ballasts.

2. Description of the Prior Art

Igniters for metal halide lamps have been in existence for many years. Metal halide lamps between one and twenty kilowatts are used in motion picture movie sets. FIG. 1 shows a typical prior art lamp and igniter configuration that consists of: (a) a step-up transformer 10 that generates 5–15 KV from ordinary 120/240 VAC house current, (b) a high current, high frequency source obtained from a capacitor 12 and a pair of spark gaps 14 in combination, capacitor 12 is charged and discharged via spark gaps 14, and (c) a pair of linear transformers 16 to further boost voltages to the 40–80 KV levels necessary to start up a metal halide lamp 18. A square-wave ballast 20 and a capacitor 22 control the power delivered to lamp 18. Capacitor 22 protects ballast 20 from high voltage. To ignite lamp 18 a voltage is applied to transformer 10 resulting in a AC sine wave being output across capacitor 12. Spark gaps 14 fire near the peaks of the AC sine wave and produce high frequency on-and-off pulses in the primaries of transformers 16. High voltage develops across the secondaries of transformers 16, and is sufficiently high to ignite lamp 18. After ignition, transformer 10 is de-energized, and ballast 20 supplies operating power in the form of 50–400 Hz square-waves. Igniters are typically mounted in a box just below the lamp reflector head in one to twenty kilowatt metal halide lamps used in motion picture production.

Metal halide lamp igniters are typically mounted on the lamp heads themselves to avoid what would otherwise result in long runs of very hazardous high voltage cabling. Besides increasing the cost, long cabling attenuates the high frequency pulses present in the ignition voltage, and therefore tends to quench ignition. On a movie set, sound booms that carry microphones are often positioned around the action and near the metal halide lamp heads. The microphones are very sensitive and will pick up noise from many sources, including the lamp igniter nearby. A relatively new source of noise came into being when the traditional magnetic ballasts were replaced with electronic, or square-wave ballasts, in lamp igniters. The replacement had become necessary because magnetic ballasts caused the lamps to rapidly dim and brighten with each alternating cycle of the AC power. This caused a flickering in the film that is eliminated by synchronizing the shutter of the cameras to the line voltage. However, this isn't usually possible for video cameras, due to the broadcast frames-per-second standards that are in conflict. Besides being expensive, the synchronization technique was clumsy and very complex.

Square-wave power sources are preferred in metal halide lamp applications because, (1) no detectable modulation of the light output of the lamp will result, the modulation being particularly troublesome in motion picture and video lighting, and (2) electronic ballasts have a size and weight advantage over conventional magnetic ballasts, and yet produce such square-wave power. Because, an electronic ballast outputs square-waves, a fullwave rectification of the square-waves produces a current that will cause no noticeable flicker in unsynchronized cameras. However, square-waves coming from the ballasts through linear transformers, such as transformers 16, cause the cores within transformers 16 to sing, but only when power levels exceed approximately one kilowatt. Practical lamp building considerations limit maximum power levels to twenty kilowatts, so the singing transformer core problem exists only at one to twenty kilowatts.

The linear transformers commonly used in the prior art include ferrite or iron cores to improve transformer efficiency. As mentioned above, such cores have an undesirable habit of mechanically vibrating at high frequency (singing). This is due to an effect called magnetostriction. These vibrations are quite different from the sixty cycle hum and vibration common to large transformers and motors. In FIGS. 2–3, a prior art transformer 30 is comprised of a core 32, a primary winding 34, and a secondary winding 36. Core 32 is shown to be cylindrical in shape, but almost any shape is possible. Core 32 is commonly constructed of iron laminate or ferrite material. Such materials are more efficient than, e.g., solid iron, because energy robbing eddy currents are greatly reduced in the core. When a lamp's power source exceeds one kilowatt and consists of square-waves, acoustic noise is emitted by core 32. (High frequency excitation of the core is caused by the high frequency fourier components of square-wave AC.) The noise is relatively high frequency audio, being in excess of one kilohertz, and ranging up to the limits of human hearing, which is 15–20 KHz. Magnetostriction is believed to generate elastic contortions in the ferrite core that rapidly expand and contract the core's length and diameter, and may even cause the ferrite core to bend and flex along its length. Some experiments by the present inventor to reduce noise by dividing a ferrite core into several segments resulted in no decrease, as the individual pieces summed up with as much noise as was produced by a single piece.

Past commercial attempts to quash the noise created by transformer cores have either involved, (1) bypassing the igniter coils with a high voltage relay, and/or (2) eliminating the core altogether, thus eliminating the vibrating element. High voltage relays are not used very often because they are complicated and expensive. Air core transformers, especially at line frequencies, are inefficient and difficult to build. Without a core, a transformer must have a larger coil, and that increases the expense.

Several United States patents address the problems in building low-noise transformers in general. Prior art squelching of the noise created by transformer cores have almost universally addressed the problem of sixty cycle hum. The U.S. Pat. No. 4,724,413 issued to Kataoka discloses a low-noise transformer for use as an output transformer of an inverter. It is comprised of a sound-proof envelope surrounding at least one of the windings for absorbing or screening vibrating noise. The vibrations of the metal wall of a housing to which a ballast is mounted are suppressed in the U.S. Pat. No. 4,000,406 issued to Bhavsar by filling with potting compound. Stray magnetic fields, and therefor the vibrations caused by them, are controlled in the U.S. Pat. No 2,806,199 issued to Sola. Control of stray magnetic fields is obtained by increasing the cross-sectional area of the flux return path relative to the cross-sectional area of the flux generating path, thus reducing the effects of magnetostriction. Vibrations in a fluorescent lamp assembly can be reduced by snugly fitting magnetic sheets or plates about the windings of a ballast or inductor. This is described in U.S. Pat. No. 2,545,163 issued to Naster. The magnetic sheets define flux paths about the inductor and avoid creation of magnetic flux in the housings and reflectors of lamps. The U.S. Pat. No. 2,572,590 issued to Björklund surrounds an iron laminae magnetic core having windings with a "pulverous synthetic mass" and is placed in a heated press and baked under high pressure. Vibrations by the core are suppressed by making the transformer into one solid block. An improved method for impregnating a magnetic core with a potting compound using wax is disclosed in U.S. Pat. No. 3,160,840 issued to Lieberman. Mechanical humming is substantially reduced by making the cross-sectional area of an air gap larger that the cross section of an associated core in U.S. Pat. No. 3,391,366 issued to within a container for a magnetic core to rest against in U.S. Pat. No. 3,018,455 issued to Brandon Jr., et al. Unsaturated polyester and a polyurethane are used in combination to encase the core-and-coil elements to reduce mechanical noise in U.S. Pat. No. 3,683,303 issued to Ayamo, et al. The conversion of vibration to heat is improved when "d" loss factor values of the resinous materials are optimized. The U.S. Pat. No. 3,704,390 issued to Grahame discloses a magnetically permeable core member which is surrounded by the rolled turns of tape-like conductive foils and intervening layers of electrical insulation to produce sound deadening.

SUMMARY OF THE PRESENT INVENTION

It is therefore an object of the present invention to provide a lamp igniter that is quiet.

It is a further object of the present invention to provide a lamp igniter that eliminates the problems associated with air core igniters.

It is a further object of the present invention to provide a lamp igniter that is inexpensive to manufacture.

It is a further object of the present invention to provide a lamp igniter that is electrically efficient.

It is a further object of the present invention to provide a lamp igniter that is small and light weight.

Briefly, a preferred embodiment of the present invention comprises a transformer having a magnetic core that is smaller and shorter than the winding form for the primary and secondary coils, the core is surrounded by an sound deadening and insulating material, such as foam, and is encased in a sealed tube.

An advantage of the present invention is that it is quiet when used with electronic or squarewave ballasts.

Another advantage of the present invention is that it is compatible with magnetic, electronic, and squarewave ballasts.

Another advantage of the present invention is that an igniter of small size and weight results from its use.

These and other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENTS

Figure 4:
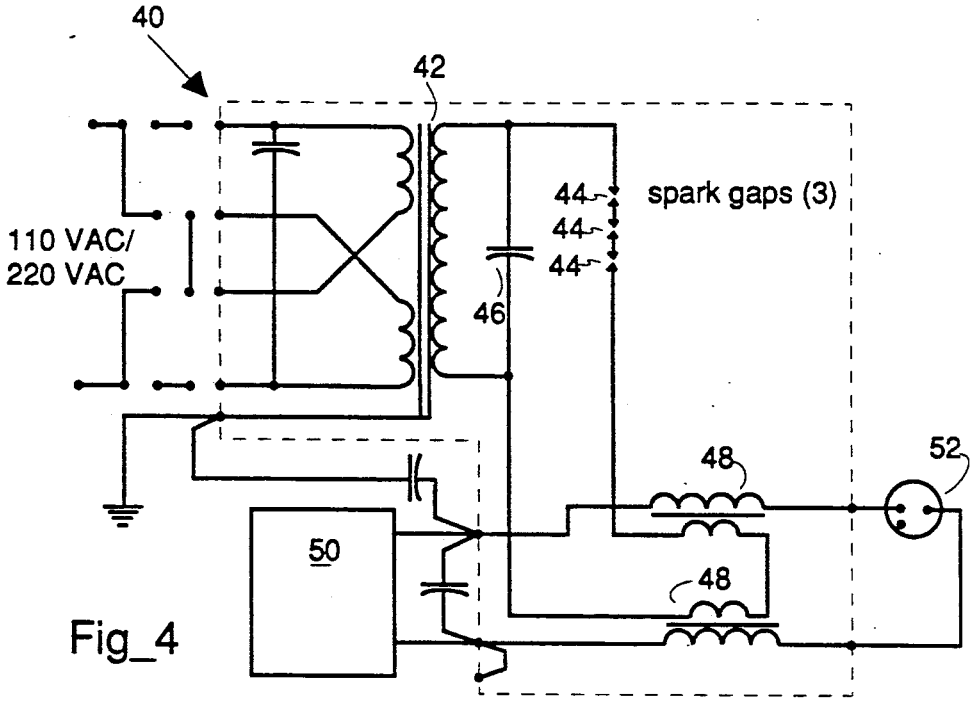
FIG. 4 is schematic diagram of an igniter ballast, and lamp constructed according to the present invention.

FIG. 4 is an embodiment of an igniter of the present invention and referred to by the general reference numeral 40. The igniter 40 comprises a step-up transformer 42, a group of three spark gaps 44 in series with the secondary of transformer 42, a capacitor 46, and a pair of linear transformers 48. An electronic ballast 50 inputs power to transformers 48. The ignition impulse voltage produced by igniter 40 during start-up is approximately sixty kilovolts. The intermittent duty rating of transformer 42 is one kilovoltampere (10 KV by 100 mA). Capacitor 46 is a 4000 picofarad, 20 KV low loss type. Spark gaps 44 have solid tungsten electrodes. An eighteen kilowatt metal halide lamp 52 is powered by igniter 40 and ballast 50 via igniter 40. Lamp 52 current through the secondaries of transformers 48 can easily approach 90 amperes, and so very low resistance inductors in transformers 48 are mandatory.

Figure 7:
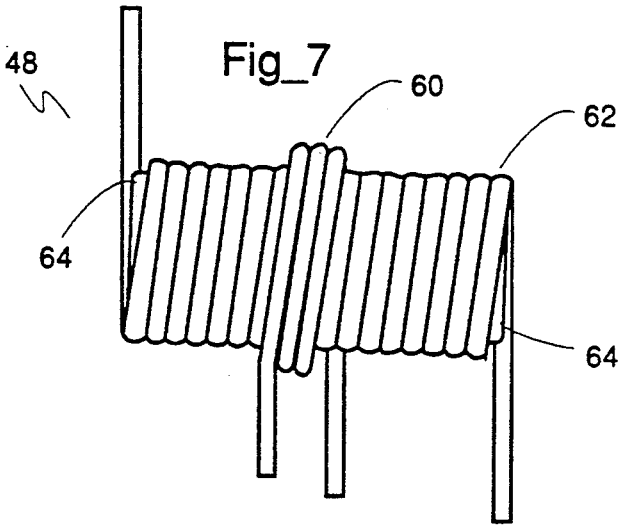
FIG. 7 is a side elevational view of the linear transformer of FIG. 4.
Figure 5:
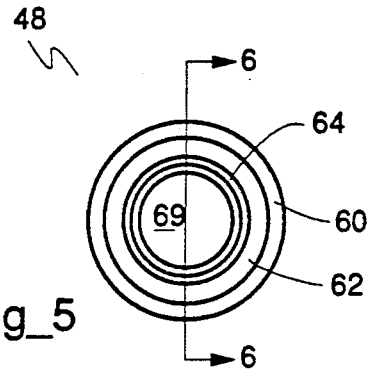
FIG. 5 is an end view of the linear transformer in FIG. 4 which incorporates the present invention.
Figure 6:
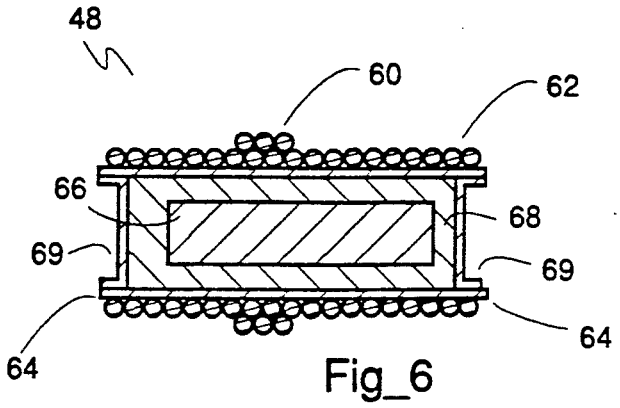
FIG. 6 is a cross-sectional view of the transformer of FIG. 5 taken along the line 6—6.

Referring to FIGS. 5-7, a typical transformer 48 will have one and one half turns of wire for a primary winding 60 and fourteen and a half turns of #4 solid copper wire for a secondary winding 62. Both windings are close spaced with a high voltage insulator wrapped over the copper wire to prevent arc over between coil turns. (Each turn can develop four kilovolts during ignition.) The secondary winding 62 has a one inch inside diameter and the primary winding 60 is wound over the secondary winding 62. Transformers 48 have an inductance of approximately 5.5 $\mu$H. Inside the secondary winding 62 is a phenolic tube 64. The tube 64 has a ferrite core 66 cushioned by a foam material 68 and a pair of end caps 69 to prevent a potting compound from entering tube during a final assembly of igniter 40. Foam material 68 must be able to withstand temperatures of 200° C. Boyd Corporation, Cellular Products (Pleasanton, Calif.) makes a polymide foam, under the trademark Solimide® that is carried as stock number TA-301, which is suitable for use as foam material 68. Core 66 is preferably made of Indiana General F414-1-Q1-7.5 ferrite rod cut into 1.65" long pieces having a 0.620" diameter.

The proper dimensions to make core 66 are empirically derived. The mechanical noise created by magnetostriction in the prior art is not considered objectionable at lamp powers below one kilowatt. At these low power levels, core 66 may be as large as tube 64, and in fact may replace tube 64. As powers increase from one kilowatt to twenty kilowatts (the practical lamp power limit) the size of core 66 must be reduced relative to tube 64. But as a consequence of this reduction, the efficiency of transformer 48 decreases because the magnetic flux lines are less and less concentrated by core 66 and are uselessly deflected away from transformer 48.

In igniter 40, this loss of efficiency requires that transformer 42 have twice the volt-ampere rating than would otherwise be necessary to drive transformers 48. It also means that three spark gaps 44 are needed, instead of the usual one or two. (Generally speaking, more spark gaps mean more output voltage to lamp 52, because each spark gap 44 raises the frequency on the primary winding 60 of transformer 48.) Both the increased size of transformer 42 and increased number of spark gaps 44 are necessary to maintain an adequate voltage to ignite lamp 52.

It has been empirically determined by the present inventor that at lamp power levels of six to eighteen kilowatts, the linear transformer 48 is preferably built according to the dimensions given above. These dimensions resulted from adjusting both the diameter and the length of core 66 while at constant loads, to result in the lowest noise level having a good margin of output voltage sufficient to ignite lamp 52. At one to four kilowatts, core 66 can be as large as the inside diameter of tube 64, and no foam material 66 is necessary. The energy being absorbed by core 66 is therefore being limited by the dimensions of core 66 in the present invention. Since the amplitude and frequency of a mechanical vibration is related to both the travel distance of a vibrating element and the energy behind those vibrations, the volume of core 66 is controlled to limit the energy being absorbed and thus available to sustain vibrations, and the diameter and length of core 66 are controlled to limit the degree of vibrational distance possible. A short distance of travel can put the frequency of vibration above twenty kilohertz, where it is not a problem. (Although some tests indicate the frequency of magnetostrictive vibration is not a function of the size of core 66.) The present invention therefore differs markedly from the prior art, because the prior art universally attempts to damp noise after it has been generated, rather than limit the forces generating the noise itself.

Figure 1:
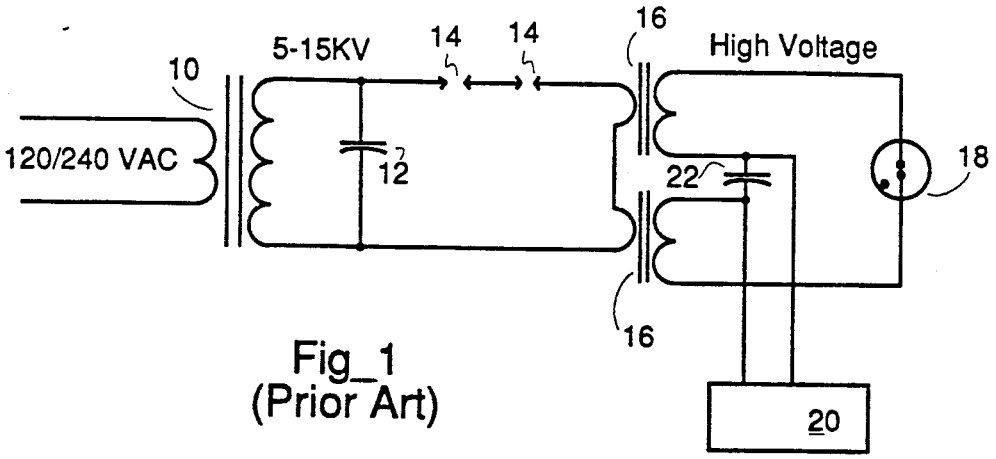
Fig 1 (Prior Art)
FIG. 1 is a schematic diagram of a prior art igniter and lamp.
Figure 2:
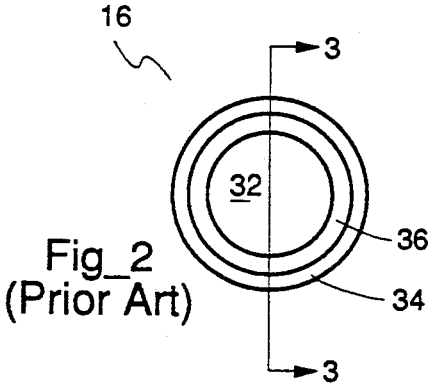
Fig 2 (Prior Art)
FIG. 2 is an end view of a prior art transformer.
Figure 3:
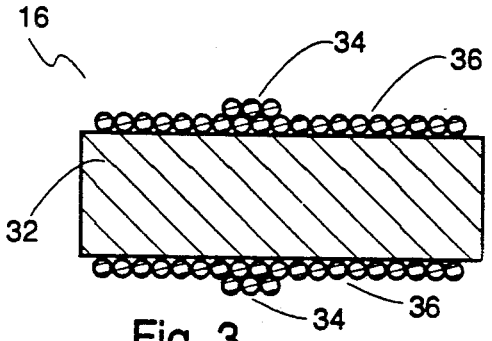
Fig 3 (Prior Art)
FIG. 3 is a cross-sectional view of the transformer of FIG. 2 taken along the line 3—3.
Figure 8A:
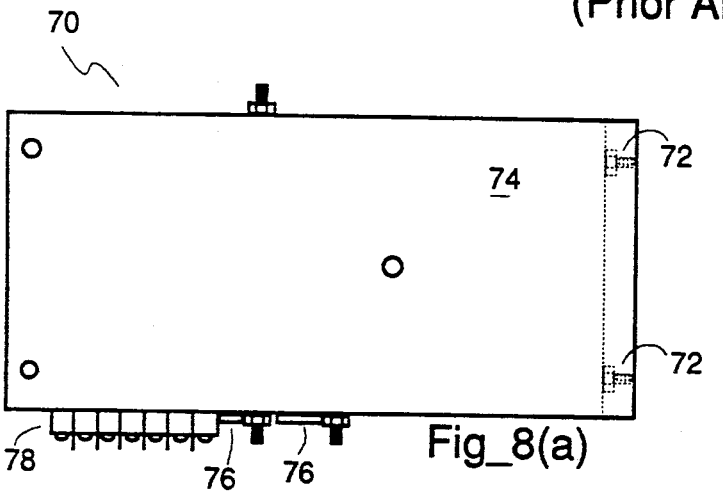
FIGS. 8(*a*)-(*c*) are top, side, and end views, respectively, of the housing which contains the igniter of FIG. 4.
Figure 8B:
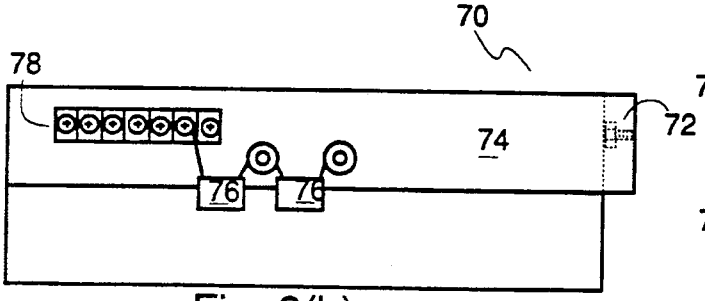
Figure 8C:
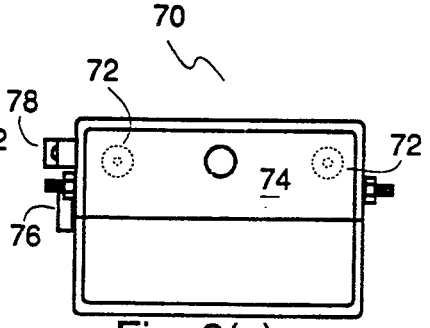

Referring now to FIGS. 8(*a*)-(*c*), a housing 70 contains igniter 40. A pair of high voltage terminals 72 are provided under a cover 74 to guard against arc-over and shock hazard. A pair of capacitors 76 are mounted externally to housing 70. A terminal strip 78 provides for electrical connection. Housing 70 is preferably filled with a commercially available epoxy potting compound after assembly to further reduce audible noise.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A lamp igniter, comprising:

output means for driving a lamp having an input power requirement greater than one kilowatt;

a step-up transformer having a volt-ampere rating sufficient to couple a high enough power to ignite said lamp, the transformer having a primary for an AC line power source and a secondary;

at least one spark gap in series with said secondary of the step-up transformer; and at least one linear transformer, having a primary winding and a secondary winding placed between the step-up transformer and the output means, the linear transformer having a reduced ability to couple power from said primary winding to said secondary winding resulting from using a core disposed within said secondary winding that is substantially smaller in size relative to dimensions of said secondary windings such that the effects of magnetostriction produce substantially no audible mechanical noise external to the lamp igniter.

2. The igniter of claim 1, wherein:

said lamp is a metal halide type.

3. The igniter of claim 1, wherein:

there are three spark gaps connected in series with one another and said secondary of the step-up transformer.

4. The igniter of claim 1, wherein:

said means for support comprises a phenolic tube having disposed within an open-cell polymide foam able to operate in a range of temperatures from approximately −300° F. to 500° F. and having an approximate density of 0.6 with an approximate 25% compression deflection of 1.2.

5. The igniter of claim 1, wherein:

said core is made of ferrite and is substantially cylindrical in shape, said core having the minimum length and diameter that optimize a trade-off between the efficiency of the linear transformer and noise produced by magnetostriction during operation of the lamp.

6. The igniter of claim 5, wherein:

said linear transformer has a primary winding of approximately one and a half closely wound turns and a secondary winding of approximately fourteen and a half closely wound turns of #4 solid copper wire, said turns being covered by an insulating means capable of insulating the turns for at least four kilovolts per turn, said primary winding being wound over said secondary winding having an inside diameter of approximately one inch; and said core is approximately 0.620 inches in diameter by 1.65 inches in length and comprised of Indiana General F414-1-7.5 ferrite or equivalent.

7. A method of reducing the audible noise caused by magnetostriction in a linear transformer used with a metal halide lamp having an input power over one kilowatt, comprising the steps of:

reducing the size of a core having a length and a diameter disposed within the linear transformer;

adding at least one spark gap in series with a primary of the linear transformer to increase an output voltage on a secondary of the linear transformer to compensate for a decrease in the efficiency of the linear transformer caused by the reducing of the size of said core;

increasing a step-up transformer volt-ampere rating to compensate for a decrease in the efficiency of the linear transformer caused by the reducing of the size of said core, said step-up transformer driving said primary of said linear transformer; and optimizing said length and diameter of said core to reduce audible noise emitted by said core while still maintaining an adequate output voltage level from said secondary of said linear transformer to ignite the lamp.

8. The method of claim 7, further including the steps of:

placing sound deadening material around said core to support said core within the linear transformer; and potting the linear transformer within a housing.

9. A linear transformer for use with loads having square-wave input powers greater than one kilowatt, the linear transformer comprising:

a primary winding for inputting of power;

a secondary winding having a predetermined length and a predetermined inside diameter, the secondary winding electromagnetically coupled to the primary winding;

a ferrite core disposed within the secondary winding and substantially smaller in size relative to said length and inside diameter of said secondary winding such that the effects of magnetostriction produce substantially no audible mechanical noise external to the linear transformer and the efficiency of said coupling of the primary winding to the secondary winding is substantially reduced; and a means for supporting the core within said secondary winding.

10. A metal halide lamp system, comprising:

(1) a metal halide lamp head having an input power greater than one kilowatt;

(2) a ballast means for powering the lamp having substantially a square-wave output waveform;

(3) an igniter comprising:

(a) a step-up transformer having a volt-ampere rating sufficient to overcome an inefficiency in coupling power to the lamp, the transformer having a primary and a secondary;

(b) a plurality of spark gaps in series with said secondary of the step-up transformer;

(c) at least one linear transformer, having a primary winding and a secondary winding placed between the step-up transformer and the lamp, the linear transformer having said inefficiency resulting from using a core disposed within said secondary winding and substantially smaller in size relative to dimensions of said secondary windings such that the effects of magnetostriction produce substantially no audible mechanical noise external to the igniter, said core isolated from said primary and secondary windings by a means for support; and (d) a housing to contain the igniter.

* * * * *